United States Patent [19]

Vella

[11] 3,940,079

[45] Feb. 24, 1976

[54] YARN FEEDING DEVICE WITH CONSTANT ADJUSTABLE TENSION, PARTICULARLY FOR FEEDING YARNS TO WEAVING AND KNITTING MACHINES AND DEVICES

[75] Inventor: Sergio Vella, Biella, Italy

[73] Assignee: Roj & Vella S.p.A., Biella, Italy

[22] Filed: Feb. 12, 1974

[21] Appl. No.: 441,864

[30] Foreign Application Priority Data

Feb. 12, 1973 Italy ..... 20286/73

[52] U.S. Cl. ..... 242/47.12; 66/132 R; 139/122 R

[51] Int. Cl.[2] ..... B65H 51/20

[58] Field of Search ..... 242/47.12, 47.13, 47.01, 242/47.05, 47.08, 47.09; 66/132 R; 139/122 R, 126, 127 R, 127 P

[56] References Cited

UNITED STATES PATENTS

| | | | |
|---|---|---|---|
| 3,782,661 | 1/1974 | Deniega et al. | 242/47.12 |
| 3,791,598 | 2/1974 | Vischiani et al. | 242/47.12 |
| 3,796,386 | 3/1974 | Tannert | 242/47.12 |

*Primary Examiner*—Stanley N. Gilreath
*Attorney, Agent, or Firm*—Young & Thompson

[57] ABSTRACT

A yarn feeding device for feeding yarns to weaving and knitting machines and devices with a constant, adjustable tension, in which a yarn reserve is wound onto a stationary cage by means of a rotating framework. The device also comprises means for braking the yarn, and means for regulating the action of said brake means and for modifying the amount of said reserve. In this device, the yarn is drawn with a constant tension, and is sent to the weaving or knitting machine or device as if it were drawn from a stationary reserve.

7 Claims, 2 Drawing Figures

YARN FEEDING DEVICE WITH CONSTANT ADJUSTABLE TENSION, PARTICULARLY FOR FEEDING YARNS TO WEAVING AND KNITTING MACHINES AND DEVICES

BACKGROUND OF THE INVENTION

The present invention relates to a yarn feeding device with constant adjustable tension, particularly for feeding yarns to weaving and knitting machines and devices.

It is known that the increase in the productivity of weaving machines depends on the possibility to impart increasingly higher speeds and accelerations to the yarns being woven; on the other hand, it is also evident that this fact, as it involves higher mechanical stresses and, hence, an increased number of breaks in the warp yarns, is in contrast with the declared purpose of increasing the productivity. In fact, at each break in the warp yarn, the machine has to be stopped in order to restore, practically always by hand, the integrity of the yarn being woven.

From this point of view, the problem of feeding weaving machines with yarns unwinding at constant tension, appears in all its importance; in fact, the fundamental cause for breaks is the irregularity of unwinding tensions, due to non-constant braking and to the irregular winding of the yarns into reels or coils. It is actually due to these irregularities that the high feeding speeds, now-a-days easily reaching about 1500 meters per minute, produce tension concentrations in very reduced times; and the resulting abrupt tensions at the weakest points of the yarn cause the breaking thereof.

The object of the present invention is to provide a yarn feeding device — to be arranged between yarn supplies, formed by reels or coils, and weaving or knitting machines or devices — adapted to eliminate any unwinding irregularities upstream of said machines or devices, and hence allowing the same to draw the yarn in a smooth and regular way.

Devices with this object are already known: for example, the Italian Patents Nos. 659,733 and 785,283 describe a device, the essential characteristics of which lie in the presence therein of a cylindrical body which may be caused to rotate by a suitable motor, a certain reserve of yarn being tangentially wound on said cylindrical body and axially unwound therefrom, and the outlet braking of the yarn being obtained by means of elastic rings under which passes the yarn itself; electronic and electromechanical systems, adapted to start and stop the rotation of said motor, allow one to check the consistency of the yarn reserve and to restore the same, when it has decreased below certain preestablished amounts, by causing the rotation of the cylindrical body; the regular arrangement of the turns on the cylindrical body is provided for by a beveled inlet edge which, producing an axial thrust, moves forward the turns as they are formed, the task of said beveled edge being facilitated by the centrifugal force which loosens the tension of the formed turns, favouring their axial sliding along the highly smooth surfaced cylindrical body.

A device adopting the same fundamental scheme as the previous ones is that according to Italian Patent No. 795,923 which, however, in order to guarantee the regular arrangement of the turns on the cylindrical body of the device, provides for the use of an oscillating plate rotating with the cylindrical body itself and adapted to push forward the turns being formed.

These devices, however, involve fairly serious drawbacks: for example, it can easily be understood how the fact of relying on the actual yarn being wound for the formed turns to be pushed forward, is itself a remarkable cause for irregularity and crossing over of the turns; moreover, in the case of hairy yarns, the turns being formed imprison beneath them the hairs of the previous turn, which fact, during unwinding, produces sufficient tears to cause the breaking of the yarn. From this point of view, the arrangement according to Italian Patent No. 795,923 is no doubt preferable; here, the task of pushing forward the turns is entrusted to the oscillating plate, which further creates a free space in the winding area of the turns being formed, preventing the crossing over of yarns and hairs. On the other hand, according to this last patent, in order to check the amount of yarn reserve, use is made of the pressure, increasing with the number of turns, which the wound turns exert on the oscillating plate. This pressure, as it increases, changes the inclination of the plate, and this causes at a certain point the tripping of the microswitch controlling the rotation of the cylindrical body and being mechanically connected, through a sliding contact, to the plate itself; this fact is highly negative, as it means that the oscillating plate, when actually varying its inclination, no longer has, at a given moment, the strength required to overcome the friction opposing the advancing of the turns; moreover, owing to reduced oscillation, there is no space left for the new turns, and the total effect is a considerable crossing over; in addition, the amount of reserve depends on the yarn friction factor, it can by no means be adjusted and it varies from case to case. From this point of view, the arrangement of the other two cited patents is preferable, as, in such patents, the yarn reserve is checked by means of a photoelectric system which "watches" when the head of the wound reserve reaches a certain position adapted to be easily predetermined by axially displacing the photoelectric receiver. This system, however, has a double drawback: the first being that it is too expensive and that therefore, from the economic point of view, it increases unduly the total cost of the device; and the second being that it is likely not to work properly, mainly due to the dust which often develops in great quantities in the room where the device is meant to operate, and which dims the excitation lamp or dirties the reflecting surfaces of the photoelectric device.

In the same devices, a further cause of low efficiency is the outlet yarn braking system, which consists of elastic rings; this system, in the first place, allows no continuous adjustment; in fact, the elastic rings being applied on the outlet edge of the cylindrical body by no means allow a regular braking action, and a different braking effect could be obtained only by changing them into other rings of different material and rigidity. In the second place, such rings usually rotate together with the cylindrical body and, hence, the braking effects produced are substantially different, according to whether the weaving or knitting machine or device draws the yarn when the winding cylinder is or is not moving; since the winding cylinder passes from standstill to rotation just at the moment when the yarn is being drawn, the latter will undergo abrupt braking changes, which will result in tension variations.

Finally, the actual fundamental principle on which are based the devices described hereabove, i.e. that of winding a yarn reserve onto a rotating element, is criticizable from the point of view of its practical realization: because of the speeds involved, and the consequent need for the rotary element to act very promptly, the latter would have to be equipped with motors having a very high take-off power, which motors designed to equip each single feeder are not likely to provide, at least for reasons of space and expense. Hence, the feeder itself does not usually provide the characteristics of autonomy which would instead be required. Moreover, since the yarn unwound by the devices based on the above principle takes part in the dynamic condition of the cylinder on which it is wound, the starting and stopping of the feeding cylinder result in sharp tension variations of the yarn itself, which is by no means in accordance with the purposes of the devices.

Therefore, another object of the present invention is to provide a constant tension yarn feeding device, allowing one to avoid all the drawbacks typical of the aforementioned known devices, and allowing one to carry out in the most rational, efficient and safe way, the feeding of modern weaving and knitting machines.

SUMMARY OF THE INVENTION

To achieve these objects, the present invention provides a yarn feeding device for weaving and knitting machines or devices, characterized in that it comprises: a fixed hollow body, around which the yarn coming from a yarn supply is wound into turns by means of an element rotating on the outside of said fixed body, and coaxially thereto, to form thereon a yarn reserve, from which the yarn is drawn to be sent to said weaving or knitting machine or device, passing through said fixed hollow body; adjustable brake means, cooperating with said fixed body, to brake the yarn at a constant rate, downstream of said yarn reserve; and means, associated with the fixed hollow body, to adjust and keep uniform the amount of said reserve. Said yarn feeding device further comprises means associated with said fixed hollow body and controlled by said rotating element, to cause the constant advancement of the yarn turns forming said reserve, wound on the fixed body.

According to a preferred embodiment thereof, the device according to the invention comprises in a casing:

- a fixed hollow body comprising a cage, formed by a bottom plate, a set of side columns, and a funnel-shaped top member having a wide upper edge and extending downwardly into the cage itself; and a hollow shaft, supporting said cage, mounted cantilevered on said casing;
- a substantially rectangular framework, surrounding said cage and mounted revolving on said shaft, comprising a bottom element with a hub, two lateral uprights, and an upper closing element;
- an oscillating plate, associated with said cage close to the bottom plate thereof, mounted around said shaft and crossed through by said columns, projections of the bottom element of said rotating framework operating on said plate to cause the oscillation thereof;
- a ring-shaped braking element, pressed against the upper edge of the funnel-shaped member of the cage by the upper closing element of said framework;

- an electric motor which, when running, causes the rotation of said framework;
- an inlet brake mounted on the casing; and
- a feeler, associated by friction with said cage, between the columns and the funnel-shaped member, adapted to be differently adjusted and to control the running of said motor;
- the yarn to be fed being let into said casing through said inlet brake and being caused by said rotary framework to wind around said cage into several turns, said turns being caused to advance by said oscillating plate up to when the advancing front of the turns engages said feeler, to pass subsequently under said ring-shaped brake element, running along the interior of the cage funnel-shaped member along a generatrix thereof, and to enter then said hollow shaft, finally coming out of the casing to run in the direction of said weaving or knitting machine or device.

BRIEF DESCRIPTION OF THE DRAWINGS

The invention will now be described in further detail, by mere way of example, with reference to the accompanying drawings, which illustrate a preferred embodiment thereof, and in which.

DESCRIPTION OF THE PREFERRED EMBODIMENT

Figure 1:
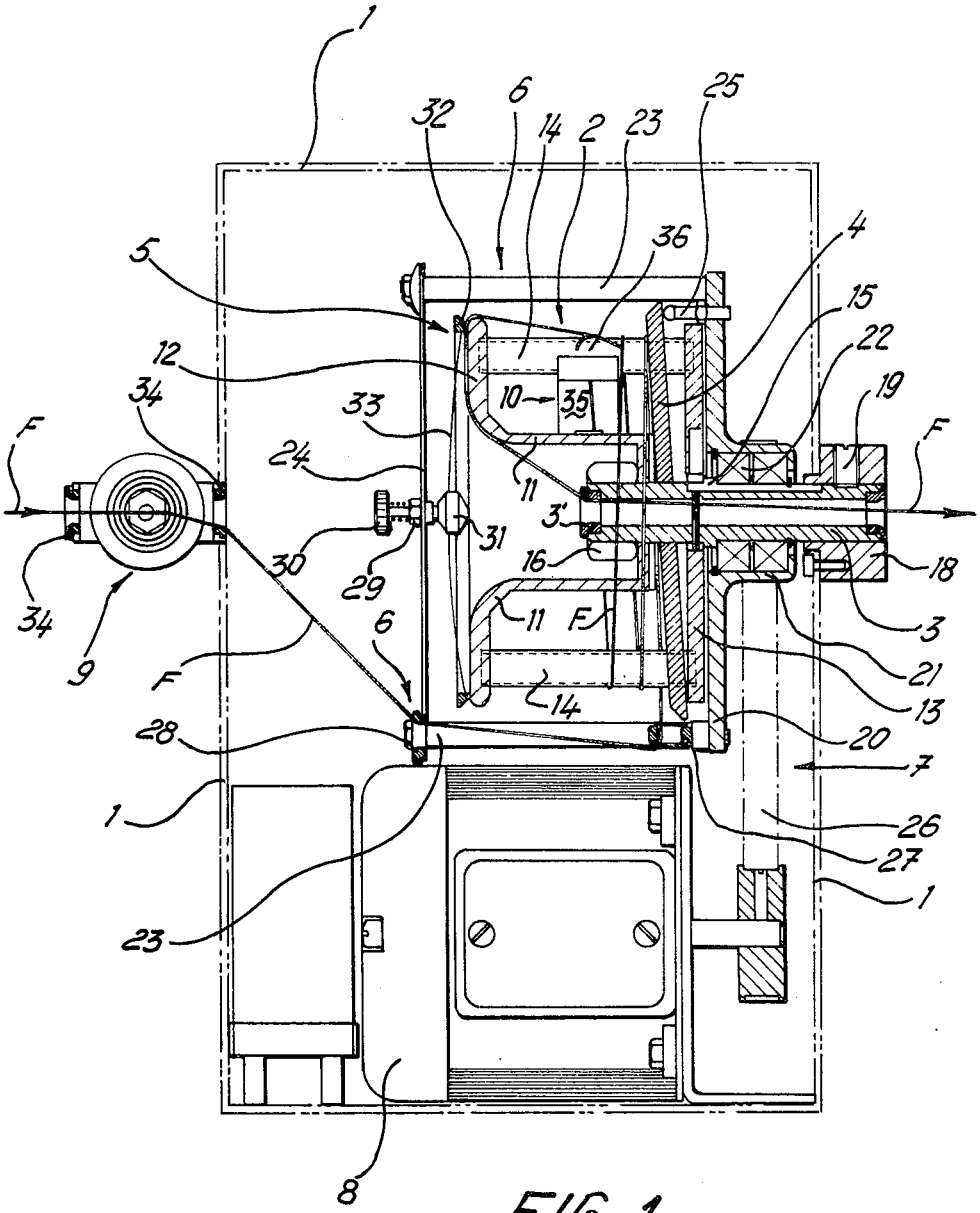
FIG. 1 is an axial, partially sectioned view, of the yarn feeding device according to the invention.
Figure 2:
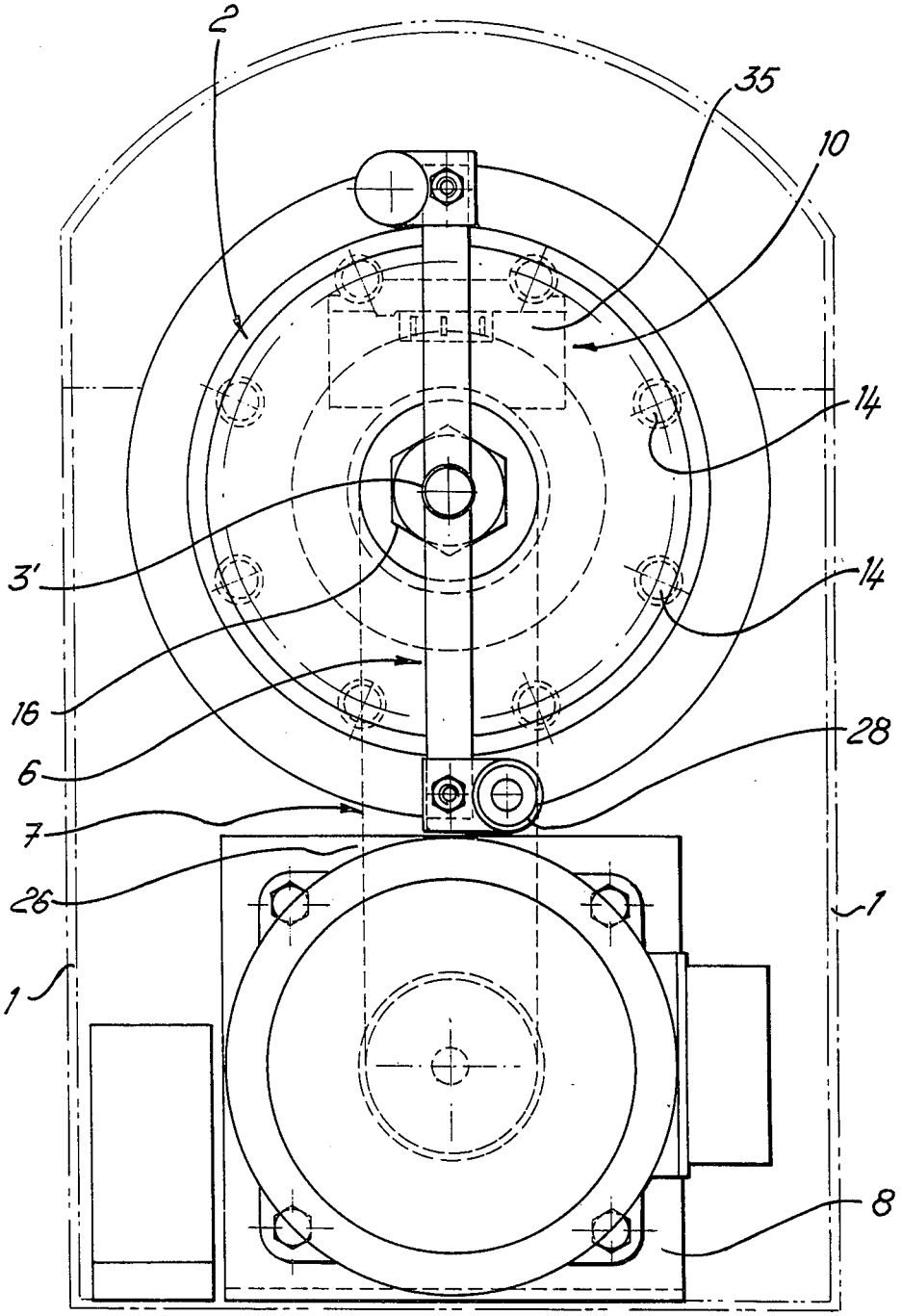
FIG. 2 is a side view of the same device, seen from the left of FIG. 1.

With reference to the drawings, the device according to the present invention comprises, within a casing 1 marked by dashed lines, a cage 2 around which is wound the yarn to be fed, said cage 2 being fixed by means of a hollow shaft 3 to the casing 1 itself, an oscillating plate 4 associated with the bottom plate of said cage 2, for advancement of the yarn turns wound around the cage itself, brake means 5 for the outlet yarn to be fed, and a framework 6 for winding around said cage 2 the yarn coming in, said framework 6 rotating about the hollow shaft 3 and being provided with means both for controlling the oscillation of the plate 4, for advancement of the turns, and for controlling the action of the brake means 5. The device is completed by a motor 8, for controlling the rotation of the framework 6 by means of a transmission 7, by an inlet brake 9, and by a device 10 for controlling the running of the motor 8, said device being associated with the cage 2.

Upon examining more closely the structure of the device, it will be seen that the cage 2 is in turn formed by a funnel-shaped top member 11, the open part of which extends into a transverse flange 12, with smoothly rounded edges, and by a bottom plate 13, connected to the member 11 by means of eight metal chromium-plated columns 14. This unit is connected to the shaft 3 — with the columns 14 arranged parallel and the plate 13 and flange 12 arranged perpendicular to the shaft 3 itself — by means of a shoulder 15 of the shaft 3, on which bears the plate 13, and by means of a screw thread at the end of the shaft itself, into which is screwed a nut 16 adapted to engage the bottom of the funnel-shaped member 11. The columns 14 are simply inserted into seats provided therefor on the opposed surfaces of the flange 12 of the member 11 and, respectively, of the plate 13, so as to press the latter against the shoulder 15, when the nut 16 is tightened.

Between the bottom of the funnel-shaped member 11 and the plate 13 of the cage 2 is arranged the already mentioned oscillating plate 4: this plate 4 is provided with a central hole, being crossed through by the hollow shaft 3, and with eight peripheral holes, crossed through by the columns 14; such holes are wide enough to allow the plate 4 to oscillate by approx. 4° about the position in which it forms right angles with the axis of shaft 3.

The shaft 3 is fixed, as already mentioned above, to the wall of the casing 1 of the device. This is achieved by means of a hub 18, fixed to the casing 1, and by means of setscrews 19, which secure this hub to the shaft 3. In view of this arrangement, both the shaft 3 and the aforementioned parts connected thereto, namely the cage 2 with its funnel-shaped member 11, the plate 13 and the columns 14, are fixed to the casing 1. The plate 4 is fixed against rotation relative to the axis of shaft 3, but is adapted to oscillate, as seen hereabove, by approx. 4° relative to the plane of plate 13.

On the outside of the unit formed by the shaft 3 and by the cage 2, is mounted the revolving framework 6. It has a substantially rectangular structure, comprising a stout bottom element 20, opening at the centre to form a hub 21 which is rotatably mounted on the shaft 3 with the interposition of a rolling bearing 22, two lateral elements or uprights 23, perpendicular to the bottom element 20 and fixed to the ends thereof, and a thin closing element 24. The bottom element 20 is provided with appropriate projections 25, extending from its inner surface close to one of the uprights 23 and acting on the oscillating plate 4 of the cage 2 so as to keep it inclined, while the hub 21 of the bottom element 20 is outwardly provided with pulley means for receiving a belt 26 transmitting movement from the motor 8. The lateral upright 23, opposite to the one close to the projection 25, is provided at the bottom with a ceramic eyelet 27, and at the top with a similar eyelet 28, the first eyelet being set in a radial position and the second eyelet being set in an axial position. The thin closing element 24 is provided at the centre with a small hub 29, on which is screwed a screw 30 ending in a threaded hard portion of small diameter, which acts as pin for the idle hub 31 of the brake means 5, associated with the top of the funnel-shaped member 11. The brake means 5 comprise a ring 32, bearing on the outer surface of the flange 12 of the member 11, or rim of the cage 2, and a set of elastic spokes 33, connecting the ring 32 to the hub 31. The hubs 29 and 31 are strictly coaxial to the shaft 3. Clearly, the brake means 5 are meant not to move in respect of the funnel-shaped member 11 with which they cooperate; in fact, when the framework 6 rotates, the ring 32 stays motionless, since the friction force between said ring and the surface of the flange 12 is far greater than the friction force between the screw 30 and the idle hub 31. It is also clear that the braking action may easily be adjusted: in fact, by rotating the screw 30, it is possible to vary the coupling force between the ring 32 and the outer surface of the flange 12 of the member 11, namely the braking action applied by these two elements on the yarn F which, as said further above, is forced to pass between them before its exit from the device.

The inlet brake 9 is also mounted coaxial to the shaft 3, on the opposite wall of the casing 1, and is provided with ceramic eyelets 34.

As already said, the feeding device according to the invention finally comprises feeler means 10, for controlling the running of the motor 8, said means being associated with the cage 2. These means substantially consist of a block 35, imprisoned between the outer wall of the funnel-shaped member 11 and a pair of columns 14, said block being normally held in a steady position by friction. It is however possible, through a small effort, to vary said position of the block in an axial sense, according to wishes and requirements, as seen hereinafter. The block 35 comprises a lever 36, engaged by the advancing front of the yarn turns wound on the cage 2, and a microswitch (not shown) operated by said lever to control the running of the motor 8.

In the device thus described, the yarn F enters the casing 1 through the inlet brake 9 and, sliding into the inner ceramic eyelet 34, runs through the two ceramic eyelets 28 and 27 of the framework 6 and winds around the ideal octagonal surface formed by the eight chromium-plated columns 14, entering, through the eyelet 27, the area in which the oscillating plate 4 allows the widest inlet space, owing to its inclination (the eyelet 27 being in a position diametrally opposite to the projections 25).

Having wound around the columns 14 for a certain number of turns, which may be adjusted as will be seen hereinafter, the yarn F introduces itself inside the funnel-shaped member 11, passing between the flange 12 of said member and the braking ring 32, and comes out from the side opposite to the entry, passing through the hollow shaft 3, into which it is let through the ceramic ring 3'.

To insert the yarn F into the feeding device, a hook-threader is used, and the operation — which is very simple — is carried out by the help of slight rotations of the motor 8, obtained by means of a special press switch. The same switch may be placed, at the end of the threading operation, in a working position to guarantee the continuous running of the motor 8.

When the general switch of the yarn feeding device is placed in a working position for the normal running of the device itself, the framework 6 starts to rotate about the shaft 3 and winds the yarn turns around the columns 14: these turns, being gently pushed one against the other by the plate 4 (which oscillates continuously under the thrust of the rotating projections 25), move forward up to when their advancing front meets the lever 36 of the block 35, which projects by a few millimeters from the tangent plane of two consecutive columns 14; the lever 36 then acts on the microswitch of the block 35 which interrupts, for example by means of an auxiliary relay, the circuit of the motor 8, which hence stops; the number of turns being formed on the cage 2 may evidently be chosen by changing the axial position of the block 35, which allows to determine the space available for the reserve turns, according to the count of the yarn being wound, so as to always feed to the weaving or knitting machine or device approximately the same yarn length, whatever the type and count of the yarn being used.

From the turns wound on cage 2, the yarn reaches the weaving or knitting machine or device in the same direction of its introduction into the feeding device, after having been braked by the brake 32 and having passed through the hollow shaft 3: the yarn may hence be drawn from a reserve which is stationary in respect of the weaving or knitting machine or device, and the condition of which is by no means influenced by the fact that the yarn feeder is moving or not. Moreover, said reserve is wound in a perfect manner, without any crossing over of yarn lengths or portions, the yarn being checked (through an adjustable self-cleaning brake) in a perfectly efficient and continuous way, so that it reaches the weaving or knitting machine or device with a strictly constant tension, which may easily be adjusted by simply modifying, through rotation of the screw 30, the action of the outlet brake.

The feeding device according to the invention allows one to obtain many advantages which make it far superior to any other means used to date for the feeding of yarn at constant tension to weaving machines and the like. To illustrate the most important of these advantages, it will be sufficient to point out that in this device:

- the yarn unwinds in respect of the weaving or knitting machine or device, from a stationary element (the cage 2), so that it is by no means influenced by the conditions of the moving parts of the feeding device;
- the yarn comes from turns which are wound in a perfectly regular way and without possibility of crossing over or of mutual engagement;
- the device for controlling the yarn reserve formed by said turns, acts on the advancing front of the actual turns, which is very simple, economical and safe;
- it is possible to adjust the number of turns and/or the distance between such turns, so as to adapt the device itself to the most varied types of yarns;
- the yarn braking is adjustable, efficient and constant in time, and the self-cleaning of the brake means can be obtained;
- the yarn inlet and outlet are in the same direction, with favourable consequences for a convenient and easy mounting of the device;
- thanks to the lightness of the framework for winding the turns, it is possible to obtain very high accelerations, even with motors of reduced power and size.

It is understood that the above detailed description and the accompanying drawings merely represent one of the possible embodiments of the device according to the present invention. Further embodiments and modifications of the embodiment described will be apparent to anyone skilled in the art.

For example, the motor 8 could be mounted differently and be otherwise connected for imparting motion to the rotary framework 6, or else this same framework and the stationary body 2 could themselves form respectively the rotor and stator of an electric motor operating the feeding device.

It is to be understood that all these different embodiments and modifications of the above described yarn feeding device fall within the scope of the present invention, as defined by the appended claims.

I claim:

1. A yarn feeding device for drawing yarn from a supply and feeding it with constant adjustable tension to a weaving or knitting machine or the like, comprising a frame, a fixed hollow body consisting of a cage supported by a hollow shaft mounted cantilevered on said frame and having an inner funnel-shaped guide member, the yarn coming from said supply being wound into turns around the cage to form thereon a yarn reserve, a rotating framework mounted on said hollow shaft on the outside of said fixed cage, means to rotate said framework, oscillating means on said fixed cage and oscillated by said rotating framework to advance the yarn turns forming said reserve on the cage means to adjust and keep uniform the amount of said reserve, brake means bearing yieldably against the cage to tension the yarn leaving the device, means to adjust the pressure with which the brake means bears against the cage, the yarn unwinding from said reserve passing between the brake means and the cage, and subsequently through the funnel-shaped member, before coming out of the device in the same direction of its inlet into the device itself, said brake means comprising at least one braking element, elastically pressed in an axial direction against a free outer edge of said cage by said rotating framework, said braking element comprising a ring and a set of elastic spokes converging into a central hub of the ring, and an adjustable screw on the rotating framework acting against said hub to press the braking ring against the cage, said screw being coaxial with the hollow shaft and freely rotatable in said hub.

2. A yarn feeding device as in claim 1, in which said means for adjusting and keeping uniform the yarn reserve consists of a feeler mounted on said cage and controlling the running of an electric motor that rotates said framework.

3. A yarn feeding device as in claim 1, in which said means for causing the advancement of the reserve yarn turns along the cage comprises an oscillating plate transverse to the axis of the cage and projections on the rotating framework to oscillate said plate.

4. A yarn feeding device for drawing yarn from a supply and feeding it with constant adjustable tension to a weaving or knitting machine or the like, comprising a casing, and in the casing:

- a fixed hollow body comprising a cage, comprised by a bottom plate, a set of side columns, and a funnel-shaped top member having a wide upper edge and extending downwardly into the cage itself; and a hollow shaft, supporting said cage, mounted cantilevered on said casing;
- a framework surrounding said cage and mounted rotatably on said shaft, comprising a bottom element with a hub, two lateral uprights, and an upper closure element;
- an oscillating plate mounted on the cage, close to the bottom plate thereof, surrounding said shaft and traversed by said columns, and projections on the bottom element of said rotating framework operating on said plate to cause the oscillation thereof;
- a ring-shaped braking element bearing yieldably against the upper edge of the funnel-shaped member of the cage and urged thereagainst by the upper closure element of said framework;
- an electric motor, connected by means of a flexible transmission, to a pulley of said hub of the rotating framework;
- an inlet brake mounted on the casing; and
- a feeler, frictionally connected to said cage, between the columns and the funnel-shaped member, to control the operation of said motor;
- the yarn to be fed passing into said casing through said inlet brake and being caused by said rotary framework to wind around said cage into several turns, said turns being caused to advance by said oscillating plate, up to when the advancing front of the turns engages said feeler, to pass subsequently under said ring-shaped brake element, running along the inside of the cage funnel-shaped member along a generatrix thereof, and then entering said hollow shaft, and finally emerging from the casing.

5. A yarn feeding device as in claim 4, in which the bottom plate of the cage bears against a shoulder of the hollow shaft, and the funnel-shaped member is fixed with its bottom to the end of the same shaft, so as to lock the side columns against said bottom plate, and seats for said columns on the funnel-shaped member and on the bottom plate of the cage.

6. A yarn feeding device as in claim 4, in which one of the lateral uprights of the rotating framework has two yarn-guiding eyelets thereon.

7. A yarn feeding device as in claim 4, in which said ring-shaped brake means comprise a braking ring and a set of elastic spokes converging into a central hub of the ring, and an adjustable screw on the rotary framework acting against said hub, to press the braking ring against said upper edge of the funnel-shaped member of the cage, said screw being coaxial to the hollow shaft and freely rotatable in said hub.

* * * * *